US007228824B2

(12) United States Patent
Glugla et al.

(10) Patent No.: US 7,228,824 B2
(45) Date of Patent: Jun. 12, 2007

(54) INTERNAL COMBUSTION ENGINE HAVING VARIABLE COMPRESSION RATIO SELECTION AS A FUNCTION OF PROJECTED ENGINE SPEED

(75) Inventors: Chris P. Glugla, Macomb, MI (US); David K. Trumpy, Farmington Hills, MI (US); In Kwang Yoo, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/266,608

(22) Filed: Nov. 3, 2005

(65) Prior Publication Data

US 2007/0095308 A1 May 3, 2007

(51) Int. Cl.
*F02B 75/04* (2006.01)

(52) U.S. Cl. ..... 123/48 R; 123/78 R

(58) Field of Classification Search .... 123/48 R–48 D, 123/78 R–78 F

See application file for complete search history.

(56) References Cited

U.S. PATENT DOCUMENTS 4,406,256 A 9/1983 Akkerman
4,553,508 A 11/1985 Stinebaugh
4,834,031 A 5/1989 Katoh et al.
4,860,711 A 8/1989 Morikawa
5,183,013 A 2/1993 Ito et al.
6,595,186 B2 * 7/2003 Hiyoshi et al. ..... 123/78 E
7,159,543 B2 * 1/2007 Hotta et al. ..... 123/48 R

* cited by examiner

*Primary Examiner*—Noah P. Kamen

(57) ABSTRACT

A method for operating an internal combustion engine. The method includes: providing a functional relationship between time rate of change in engine speed, and compression ratio switching engine speed limit; determining time rate of change in engine speed; determining from the determined rate of change of engine speed and the function whether the engine speed exceeds the compression ratio switching engine speed; and commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

10 Claims, 4 Drawing Sheets

Control System Diagram

INTERNAL COMBUSTION ENGINE HAVING VARIABLE COMPRESSION RATIO SELECTION AS A FUNCTION OF PROJECTED ENGINE SPEED

TECHNICAL FIELD

This invention relates generally to variable compression ratio internal compression engines.

BACKGROUND AND SUMMARY

As is known in the art, the "compression ratio" of an internal combustion engine is defined as the ratio of the cylinder volume when the piston is at bottom-dead-center (BDC) to the cylinder volume when the piston is at top-dead-center (TDC)—generally, the higher the compression ratio, the higher the thermal efficiency and fuel economy of the internal combustion engine. Unfortunately, compression ratios are limited by the availability of high-octane fuels needed to prevent combustion detonation or knock at high engine loads, and therefore a compression ratio is selected to operate on available fuels, and avoid knock. So-called "variable compression ratio" internal combustion engines have been developed, for example, having higher compression ratios during low load conditions and lower compression ratios during high load conditions.

In an engine with a variable compression ratio mechanism, the engine compression ratio can be selected to achieve the best fuel economy of a vehicle. However, drivability and engine knock issues may occur by changing engine compression ratio while driving a vehicle in different environmental conditions. To ensure the switching of compression ratio happens with minimum knock and as smooth as possible at every possible real-world driving condition, not only must the engine operating conditions be taken into consideration but also environmental conditions have to be taken into considered in the compression ratio selection. The problem is how to take into account those factors so as to select appropriate engine compression ratio to obtain optimum fuel economy without sacrificing drivability.

In one variable ratio internal compression ratio system, the Variable Compression Ratio (VCR) mechanism does not allow the engine to change Compression Ratio (CR) when engine speed is greater than a certain limit (this limit is referred to herein as compression ratio switching engine speed limit). More particularly, the CR change is only possible either at intake or exhaust stroke. Therefore, for such VCR mechanism to execute CR switching, certain time duration of intake or exhaust time period is required. However, as the engine speed increases, the time that a cylinder stays on either intake or exhaust stroke gets smaller, explaining why the VCR mechanism is not capable of switching from one CR to the other CR at higher engine speed. When the VCR engine loses an opportunity to switch to low compression mode at a higher engine speed, it may result in severe engine knock at higher engine load and speed, possibly resulting in engine damage.

One of the possible and practical solutions for this problem is to switch to low compression mode in advance when the engine speed is projected to exceed the compression ratio switching engine speed limit.

In accordance with the invention, a method is provided for operating an internal combustion engine comprising selecting a compression ratio for the engine as a function of a projected engine speed.

In accordance with the present invention, the system predicts whether the engine speed may exceed the compression ratio switching engine speed limit.

In accordance with the invention, a method is provided for operating an internal combustion engine. The method includes: providing a functional relationship between time rate of change in engine speed, and compression ratio switching engine speed limit; determining time rate of change in engine speed; determining from the determined rate of change of engine speed and the function whether the engine speed exceeds the compression ratio switching engine speed; and commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

In one embodiment, the prediction is a function of the derivative of engine speed (i.e., the time rate of change in engine speed, d[engine_speed]/dt), which is calculated at each time the engine speed is sampled in the Engine Control Module (ECM). This derivative of engine speed indicates whether the engine speed was increasing or decreasing during last sampling period (i.e., positive derivative number indicates engine speed was increasing and negative means engine speed is decreasing).

In one embodiment, a method is provided for operating an internal combustion engine. The method includes providing a function relating time rate of change in engine speed and a compression ratio switching engine speed limit. The compression ratio switching engine speed limit is related to the engine speed at which to initiate compression ratio switching. The engine is operated with a compression ratio selected in accordance with engine operating conditions independent of a time rate of change in engine speed. A time rate of change in engine speed is determined during the engine operation. The method determines from the determined time rate of change in engine speed, the compression ratio switching engine speed limit. The engine is commanded to operate at a relatively low compression ratio if the engine speed exceeds the compression ratio switching engine speed limit; otherwise, the engine continues to operate with a compression ratio selected in accordance with engine operating conditions independent of a time rate of change in engine speed.

In one embodiment, to reduce the effect of signal noise generation which may result from using the derivative of engine speed, depending on the engine inertia or rate of throttle manipulation, the system includes a filter for filtering engine speed derivative, for example, with a software filter. With such filtering, smooth engine speed trends can be obtained (again, positive indicating engine speed increment and negative indicating engine speed reduction without too much of signal noise.

In one embodiment, the filtered engine speed derivative and the table is a two-dimensional (2-D) function. The method uses the filtered derivative with the 2 D look-up function threshold to determine if the engine speed is going to exceed the compression ratio switching engine speed limit or not. Current rate of change of engine speed is used as an independent variable of this 2D threshold table so that it can be calibrated with different threshold at different engine speed.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
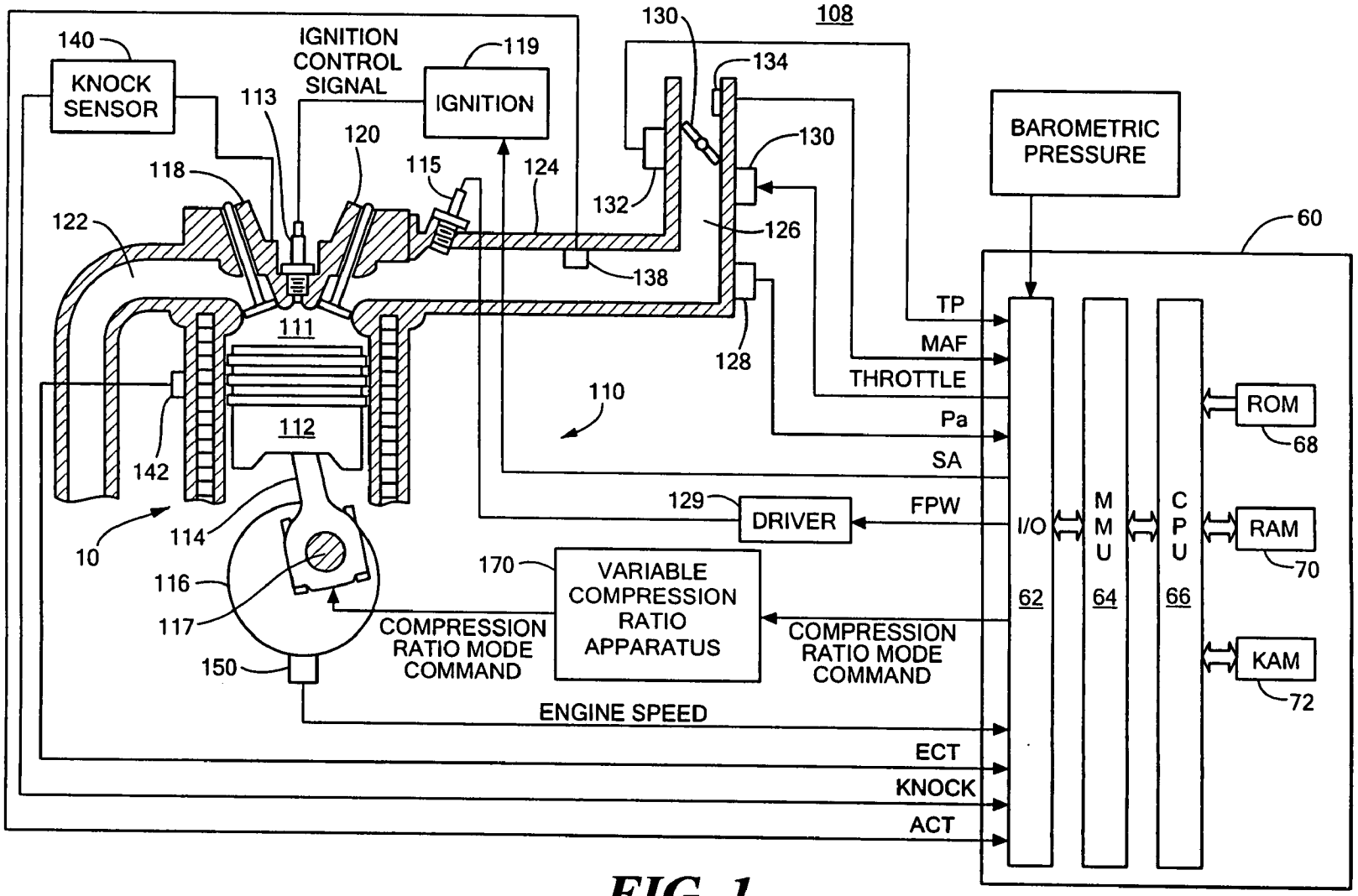
FIG. 1 is a diagram of an internal combustion engine having variable compression ratio and a controller for selecting such ratio in accordance with the invention.

FIG. 1 shows an exemplary variable compression ratio internal combustion engine 10 in accordance with the present invention. As will be appreciated by those of ordinary skill in the art, the present invention is independent of the particular underlying engine configuration and component designs, and as such can be used with a variety of different internal combustion engines having more than one compression ratio operating modes. The engine, for example, can be constructed and arranged as a discrete compression ratio engine operating for example at a high compression or at low compression, or as a continuously variable compression ratio engine capable of operating at an infinite number of discrete compression ratios. Similarly, the present invention is not limited to any particular type of apparatus or method required for varying the compression ratio of the internal combustion engine.

Referring again to FIG. 1, the engine 110 includes a plurality of cylinders (only one shown), each having a combustion chamber 111, a reciprocating piston 112, and intake and exhaust valves 120 and 118 for communicating the combustion chamber 111 with intake and exhaust manifolds 124 and 122. The piston 112 is coupled to a connecting rod 114, which itself is coupled to a crankpin 117 of a crankshaft 116. Fuel is provided to the combustion chamber 111 via a fuel injector 115 and is delivered in proportion to a fuel pulse width (FPW) determined by an electronic engine controller 60 (or equivalent microprocessor-based controller) and electronic driver circuit 129. Air charge into the intake manifold 124 is nominally provided via an electronically controlled throttle plate 136 disposed within throttle body 126. Ignition spark is provided to the combustion chamber 111 via spark plug 113 and ignition system 119 in accordance with a spark advance (or retard) signal (SA) from the electronic controller 60.

As shown in FIG. 1, the engine controller 60 nominally includes a microprocessor or central processing unit (CPU) 66 in communication with computer readable storage devices 68, 70 and 72 via memory management unit (MMU) 64. The MMU 64 communicates data to and from the CPU 66 and among the computer readable storage devices, which for example may include read-only memory (ROM) 68, random-access memory (RAM) 70, keep-alive memory (KAM) 72 and other memory devices required for volatile or non-volatile data storage. The computer readable storage devices may be implemented using any known memory devices such as semiconductor chip programmable read-only memory (PROM's), electrically programmable read-only memory (EPROM's), electrically erasable PROM (EEPROM's), flash memory, or any other electrical, magnetic, optical or combination memory devices capable of storing data, including executable code, used by the CPU 66 for controlling the internal combustion engine and/or motor vehicle containing the internal combustion engine. Input/output (I/O) interface 62 is provided for communicating with various sensors, actuators and control circuits, including but not limited to the devices shown in FIG. 1. The executable code instructions for providing the combustion ratio selection will be described below in connection with FIG. 3. These devices include an engine speed sensor 150, electronic fuel control driver 129, ignition system 119, manifold absolute pressure sensor (MAP) 128, mass air flow sensor (MAF) 134, throttle position sensor 132, electronic throttle control motor 130, inlet air temperature sensor 138, engine knock sensor 140, and engine coolant temperature 142.

The engine 110 of FIG. 1 also includes and a variable compression ratio apparatus 170. In a non-limiting embodiment, the variable compression ratio apparatus 170 is operated to vary the effective length of the connecting rod 114, and thus the clearance volume and compression ratio of the engine. Such an apparatus is described, for example, in U.S. application Ser. No. 09/682,263, entitled "Connecting Rod for a Variable Compression Engine," which is owned by the assignee of the present invention and is hereby incorporated by reference in its entirety. The actual construction and configuration of the variable compression apparatus shown in FIG. 1 is not at all intended to limit the scope of claim protection for the inventions described herein. Other examples are described in U.S. Patent Published Patent Application Publication No. 2005/0150471 A1 "Variable Compression Ratio Connecting Rod for Internal Combustion Engine" and U.S. Pat. No. 6,857,401 B1 "Variable Compression Ratio Sensing System for Internal Combustion Engine", both assigned to the same assignee as the present invention.

In a non-limiting aspect of the present invention, the variable compression ratio apparatus of FIG. 1 is described below as operating in a "high" compression ratio mode (compression ratio of 13:1 and above) or a "low" compression ratio mode (compression ratio of 11:1 and below).

Figure 2:
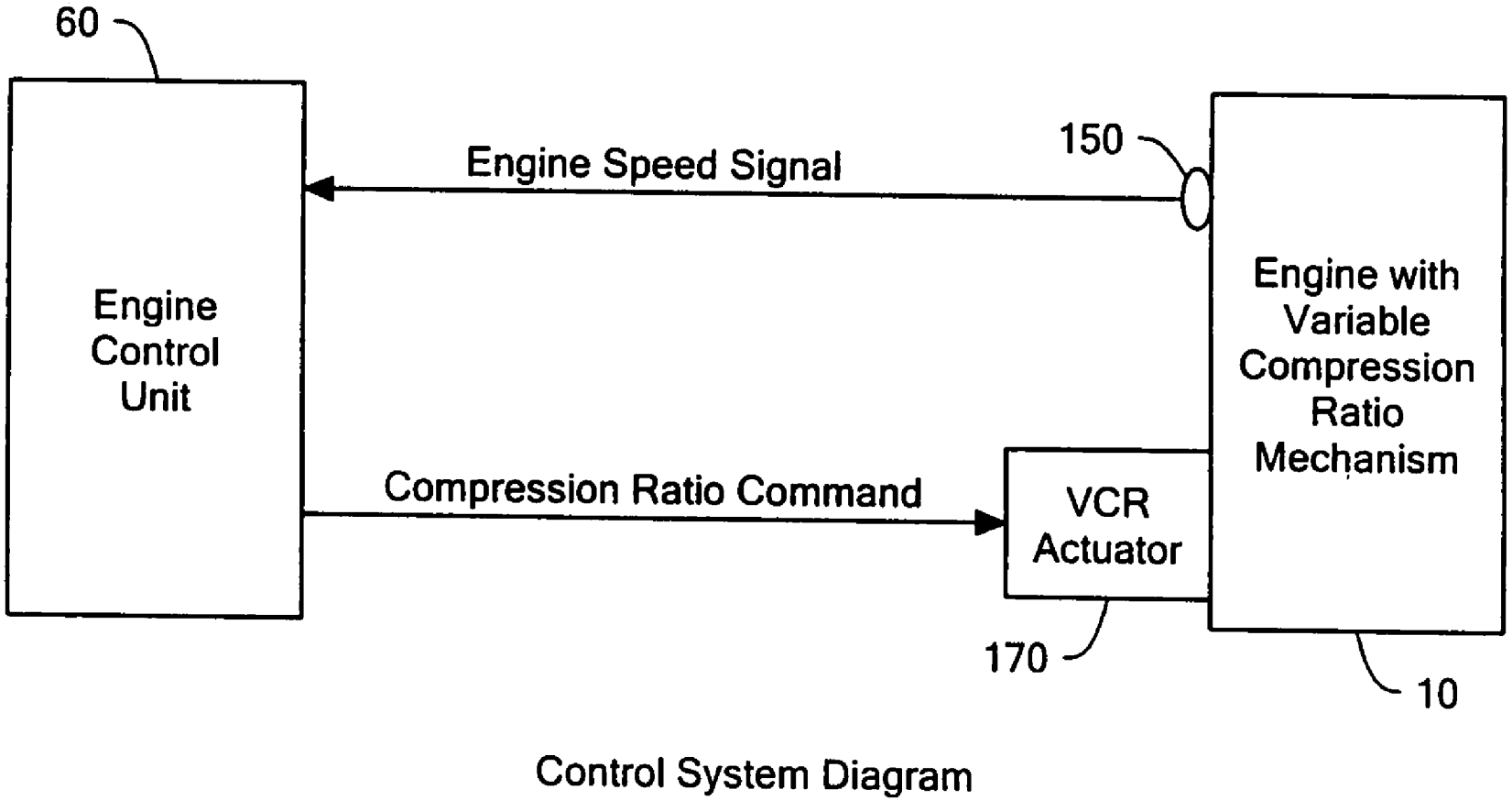
FIG. 2 is a simplified diagram of the engine of FIG. 1.

A simplified diagram of the engine system of FIG. 1 is shown in FIG. 2. Thus, the system includes the VCR (Variable Compression Ratio) engine, an engine speed sensor, and a VCR control mechanism. The engine speed sensor senses engine speed and sends it to the Engine Control Unit. The VCR control mechanism may consist of solenoids, hydraulic system, and a compression ratio changing mechanism as noted above.

This engine speed derivative (i.e., time rate of change in engine speed) algorithm is used only when the compression ratio has been determined to be high (HCR) by the main CR selection algorithm. The calculation of derivative engine speed is performed and then it is filtered. Different kinds of software filters can be used in this process or even a moving average can be also used. This filtered derivative of engine speed is then compared to a threshold look up function (Thre_engspd) to determine if the current trend of engine speed will exceed the compression ratio switching engine speed limit in the next few engine cycles. When the engine speed is greater than Thre_engspd, the algorithm will command to switch low compression ratio (LCR). Since the independent variable of the Thre_engspd function is current rate of change of engine speed, a different adjustment or thresholding is possible depending on current rate of change of engine speed.

Figure 3:
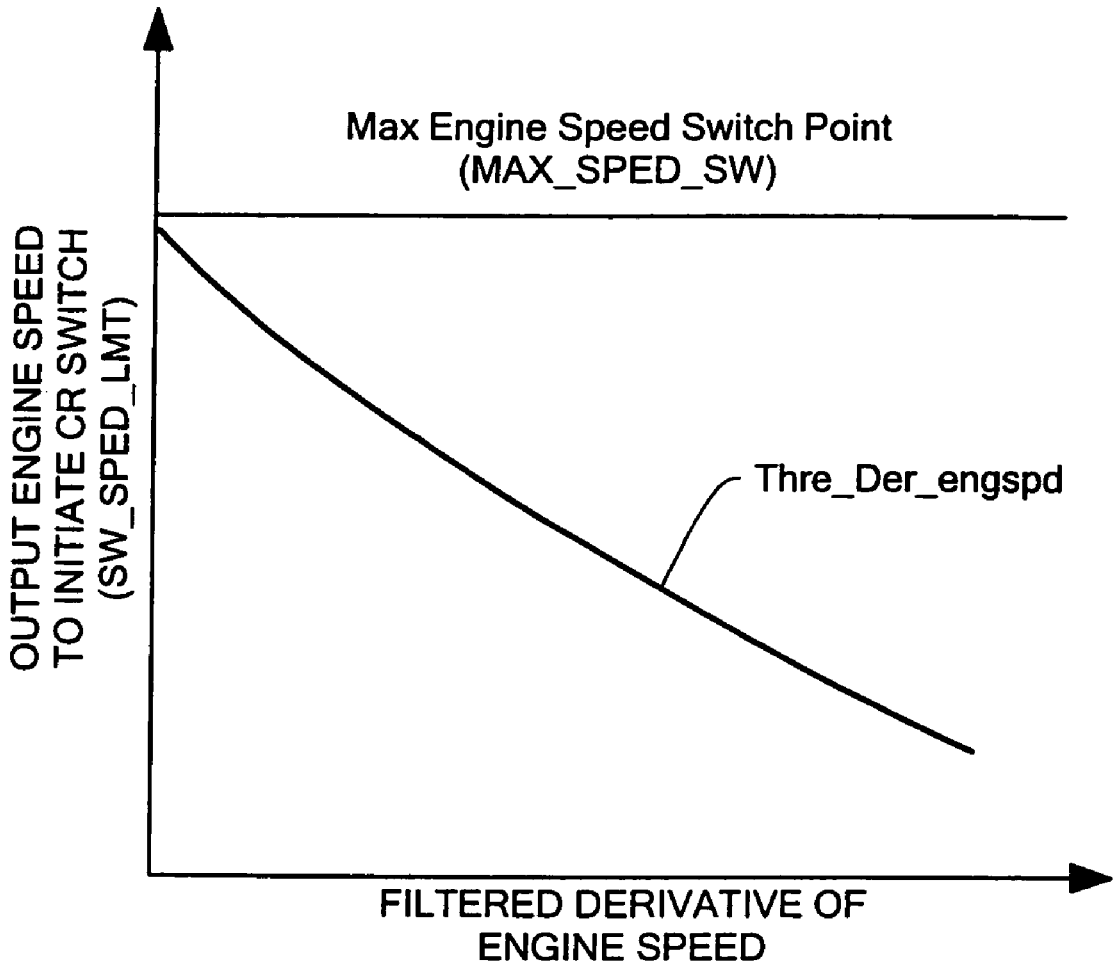
FIG. 3 is a curve representing a function Thre_Der_engspd generated by testing the engine of FIG. 1, such function being used to determine whether the current trend of engine speed will exceed the compression ratio switching engine speed limit (i.e., Max Engine Speed Switch Point, MAX_Sped_SW) within a time in which the compression ratio of the engine is able to switch between a high compression ratio and a low compression ratio.

More particularly, referring also to FIG. 3, a function (Thre_Der_engspd) relating time rate of change in engine speed and a compression ratio switching engine speed limit (SW_Sped_Lmt) is generated a priori from testing the engine on a dynamometer, for example. The function, Thre_Der_engspd, is generated by testing the engine to determine for a plurality of engine speed rates of change and, for each such engine speed rates of change to determine whether the current trend of engine speed will exceed the compression ratio switching engine speed limit (SW_Sped_Lmt) in the next few engine cycles, more particularly within a time in which the engine is able to switch between a high compression ratio and a low compression ratio. For example, assuming for purposes of understanding that the time to switch compression ratio is T, the maximum engine switching speed switch point (i.e., Max Engine Speed Switch Point, MAX_Sped_SW), and the rate of change in engine speed is d[engine_speed]/dt. In this example, SW_Sped_Lmt=MAX_Sped_SW minus d[engine_speed]/dt times T. Thus, as d[engine_speed]/dt increases SW_Sped_Lmt) decreases, as indicated in FIG. 3. It is noted that the process predicts what the engine speed will be at time T in the future from current engine speed and then determines whether the projected engine speed will exceed MAX_Sped_SW. i.e. whether the projected engine speed at time T, SW_Sped_Lmt plus d[engine_speed]/dt times T will exceed MAX_Sped_SW.

Figure 4:
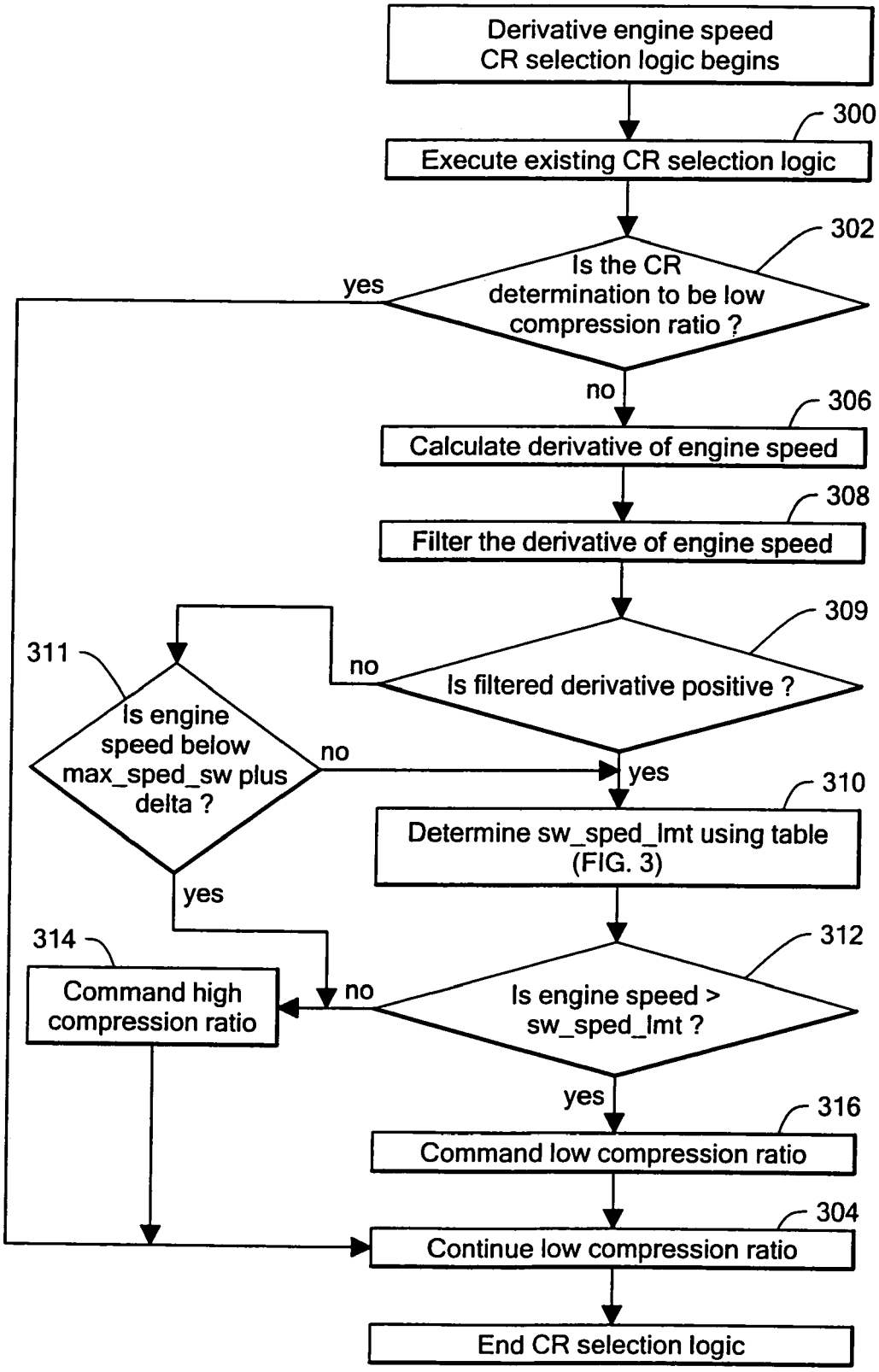
FIG. 4 is a flow diagram of a method used to control the engine of FIG. 1 according to the invention.

Referring to FIG. 4, the method for controlling the VCT is shown.

The process begins by determining the main CR selection algorithm using a process other than this engine speed derivative algorithm; i.e., a variable compression ratio system method operating independently of the time rate of change of engine speed. One such system is described in patent application Ser. No. 10/858,800 entitled "COMPRESSION RATIO MODE SELECTION LOGIC FOR AN INTERNAL COMBUSTION ENGINE HAVING DISCRETE VARIABLE COMPRESSION RATIO CONTROL MECHANISM", filed Jun. 3, 2004 assigned to the same assignee as the present invention, the entire subject mater thereof being incorporated herein by reference. See Step 300.

The process determines, in Step 302, whether the compression ratio (CR) is low. If it is low, the engine continues to operate in the current mode. Step 304. If, however, the CR is determined in Step 302 to be high, the process calculates the time rate of change in engine speed (i.e., the derivative of engine speed) d[engine_speed]/dt, Step 306. The derivative of engine speed is calculated in the electronic engine controller 60 (FIG. 1) from the speed sensor 150.

The process then filters the derivative of engine speed, Step 308. Different kinds of software filters can be used in this process or even moving average can be also used. This filtered derivative of engine speed is then compared to the threshold look up function (Thre_Der_engspd) FIG. 3 to determine if the current trend of engine speed will exceed the compression ratio switching engine speed limit in the next few engine cycles, i.e., within the compression ratio switching time, T.

The process then determines whether the engine speed is increasing, i.e., whether the filtered derivative of engine speed is positive, Step 309. If the engine speed is increasing (i.e., the filtered derivative of engine speed is positive, the, the filtered derivative of engine speed is input to the function Thre_Der_engspd shown in FIG. 3 to determine the output speed at which to initiate CR switching from high to low, i.e., compression ratio switching engine speed limit (SW_Sped_Lmt), Step 310.

On the other hand, if in Step 309 it is determined that the engine speed is decreasing, i.e., the filtered derivative of engine speed is not positive, the process checks to determine whether the engine speed is below the maximum engine speed switch point (MAX_Sped_SW) plus delta, where delta is a fixed small engine speed used to provide hysteresis, i.e., toggling back and forth around MAX_Sped_SW, Step 311. If the engine speed is not less than (MAX_Sped_SW) plus delta, the process proceeds to Step 310, described above. In such case, the next step is to determine whether the actual engine speed is greater than compression ratio switching engine speed limit (SW_Sped_Lmt), Step 312. If the actual engine speed is greater than compression ratio switching engine speed limit (SW_Sped_Lmt), Step 312, the engine is commanded to operate in the high compression ratio mode, Step 314, and continues in this mode. On the other hand, if, in Step 312, it is determined that the actual engine speed is less than compression ratio switching engine speed limit (SW_Sped_Lmt), the engine is commanded to operate in the low compression ratio mode, Step 316, and continues in this mode. Step 304.

On the other hand, if in Step 311 it is determined that the engine speed is less than (MAX_Sped_SW) plus delta, the engine is commanded to operate in the high compression ratio mode, Step 314, and continues in this mode, as described above.

It should be understood that while the compression ratio switch time, T, was assumed constant, the switch time could vary with engine oil viscosity, engine temperature, for example, and thus, such time may be adjusted as a function of the viscosity of the engine oil or engine temperature. It is also noted that the MAX_Sped_LMT in FIG. 3 may be set slightly lower than the absolute maximum engine speed switch point, for example 50 rpm lower, to ensure that the system can reliably switch.

A number of embodiments of the invention have been described. Nevertheless, it will be understood that various modifications may be made without departing from the spirit and A number of embodiments of the invention have been described. Nevertheless, it will be understood that various modifications may be made without departing from the spirit and scope of the invention. Accordingly, other embodiments are within the scope of the following claims.

What is claimed is:

1. A method for operating an internal combustion engine, comprising:

projecting an engine speed;

comparing the projected engine speed with a threshold engine speed; and selecting a compression ratio for the engine based on such comparison.

2. A method for operating an internal combustion engine, comprising:

providing a function storing a relationship between time rate of change in engine speed, and compression ratio switching engine speed limit;

determining time rate of change in engine speed;

determining from the determined rate of change of engine speed and the function whether the engine speed exceeds the compression ratio switching engine speed; and commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

3. The method recited in claim 2 wherein the time is a function of engine temperature.

4. The method recited in claim 2 wherein the time is a function of engine oil viscosity.

5. A method for operating an internal combustion engine, comprising:

providing a function storing a relationship between time rate of change in engine speed and a compression ratio switching engine speed limit;

operating the engine with a compression ratio selected in accordance with engine operating conditions independent of a time rate of change in engine speed;

determining a time rate of change in engine speed during said engine operation;

determining from the determined rate of change of engine speed and the function whether the engine speed exceeds the compression ratio switching engine speed; and commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

6. The method recited in claim 5 wherein the time is a function of engine temperature.

7. The method recited in claim 5 wherein the time is a function of engine oil viscosity.

8. An internal combustion engine system, comprising:

a memory of storing a function of a relationship between time rate of change in engine speed, and compression ratio switching engine speed limit;

a processor for:

determining time rate of change in engine speed;

determining from the determined rate of change of engine speed and the function whether the engine speed exceeds the compression ratio switching engine speed; and commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

9. An internal combustion engine system, comprising:

a memory for storing a function of a relationship between time rate of change in engine speed, and compression ratio switching engine speed limit;

a processor for:

operating the engine with a compression ratio selected in accordance with engine operating conditions independent of a time rate of change in engine speed;

determining a time rate of change in engine speed during said engine operation;

determining from the determined rate of change of engine speed and the function whether the engine speed exceeds the compression ratio switching engine speed; and commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

10. An article of manufacture comprising:

a computer storage medium having a computer program encoded therein for selecting compression ratio of a variable compression ratio internal combustion engine when such engine is operating under an idle speed condition, said computer storage medium comprising:

code for determining time rate of change in engine speed;

code for determining from the determined rate of change of engine speed and a function storing a relationship between time rate of change in engine speed and compression ratio switching engine speed limit, whether the engine speed exceeds the compression ratio switching engine speed; and code for commanding the engine to operate at a relatively low compression ratio if the determined time of change in engine speed exceeds the compression ratio switching engine speed limit and commanding the engine to operate at a relatively high compression ratio if the determined time of change in engine speed is less than the compression ratio switching engine speed limit.

* * * * *